US011458352B2

(12) United States Patent
Cohan-French et al.

(10) Patent No.: US 11,458,352 B2
(45) Date of Patent: Oct. 4, 2022

(54) ERGONOMIC HAND AND WRIST SUPPORT DEVICE FOR YOGA

(71) Applicants: Jody Cohan-French, Huntington Beach, CA (US); Maria Cristina Jimenéz, Los Angeles, CA (US)

(72) Inventors: Jody Cohan-French, Huntington Beach, CA (US); Maria Cristina Jimenéz, Los Angeles, CA (US)

( * ) Notice: Subject to any disclaimer, the term of this patent is extended or adjusted under 35 U.S.C. 154(b) by 2 days.

(21) Appl. No.: 15/873,074

(22) Filed: Jan. 17, 2018

(65) Prior Publication Data

US 2018/0200565 A1 Jul. 19, 2018

Related U.S. Application Data

(60) Provisional application No. 62/446,842, filed on Jan. 17, 2017.

(51) Int. Cl.
*A63B 21/00* (2006.01)

(52) U.S. Cl.
CPC ..... *A63B 21/4035* (2015.10); *A63B 21/4037* (2015.10); *A63B 2209/00* (2013.01)

(58) Field of Classification Search
CPC ..... A63B 21/0371; A63B 21/4039; A63B 21/4037; A63B 23/1236; A63B 26/003; A63B 21/4035; A63B 2209/00; G06F 3/0395
USPC ..... 248/687, 633, 632, 678, 118, 118.1, 248/346.01, 346.2; 361/679.19; 482/44, 482/148
See application file for complete search history.

(56) References Cited

U.S. PATENT DOCUMENTS 1,477,460 A * 12/1923 Smith ..... A63B 60/40 473/518
1,778,545 A * 10/1930 Allen ..... A61J 9/0684 215/11.6
2,159,972 A * 5/1939 Larson ..... A63B 31/08 441/58
4,043,330 A * 8/1977 Bansal ..... A61M 5/52 128/877
4,387,895 A * 6/1983 Steel ..... A63B 60/40 473/518

(Continued)

OTHER PUBLICATIONS

SPRI Balance Pods Hedgehog Stability Balance Trainer Dots. https://www.amazon.com/SPRI-Balance-Hedgehog-Stability-Trainer/dp/B0015SBRCG/ref=cm_cr_arp_d_product_top?ie=UTF8 (Year: 2013).*

*Primary Examiner* — Eret C McNichols
*Assistant Examiner* — Michael McDuffie
(74) *Attorney, Agent, or Firm* — Hackler Daghighian Martino & Novak

(57) ABSTRACT

An ergonomic hand and wrist support device for yoga includes a flat bottom surface having a circular perimeter and a curved top surface opposite the bottom surface. The top surface is connected to the bottom surface at the circular perimeter. The curved top surface has the shape of an oblate spheroid, the oblate spheroid defining a major axis perpendicular to a minor axis. The flat bottom surface is perpendicular to a minor axis of the oblate spheroid. A plurality of texture and/or alignment bumps are disposed on the curved top surface. The plurality of texture/alignment bumps are organized into a plurality of rows. The device has a Shore A hardness of equal to or between 35-75.

17 Claims, 5 Drawing Sheets

(56) References Cited

U.S. PATENT DOCUMENTS 4,613,131 A * 9/1986 Anderson ..... A63B 21/0004 482/146
4,932,911 A * 6/1990 Albrecht ..... A63B 31/10 441/56
5,265,835 A * 11/1993 Nash ..... A47B 21/0371 248/118
5,475,882 A * 12/1995 Sereboff ..... A47C 27/085 5/644
6,048,325 A * 4/2000 Kendall ..... A47B 21/0371 248/118
6,093,159 A * 7/2000 Racoosin ..... A61H 15/0092 601/118
6,162,149 A * 12/2000 Scatterday ..... A63B 21/00189 482/44
6,193,196 B1 * 2/2001 Hesley ..... G06F 3/03543 248/118.1
6,506,271 B1 * 1/2003 Yates ..... B32B 25/08 156/77
6,551,225 B1 * 4/2003 Romero ..... A63B 21/0004 482/145
6,575,885 B1 * 6/2003 Week ..... A63B 21/0004 482/146
6,766,536 B1 * 7/2004 Aarons ..... A41B 11/008 2/161.3
7,156,791 B2 * 1/2007 Edwards ..... A63B 21/0004 446/120
7,618,349 B1 * 11/2009 Muderick ..... A63B 21/028 482/44
8,171,585 B2 * 5/2012 Mead ..... A41D 31/0044 2/455
8,678,985 B2 * 3/2014 Mattox ..... A63B 21/0004 482/142
8,814,768 B1 * 8/2014 Yang ..... A63B 23/1236 482/147
9,056,222 B2 * 6/2015 Thomason ..... A63B 23/1236
9,314,662 B1 * 4/2016 Willison ..... A63B 21/4035
9,555,275 B1 * 1/2017 Izzolo, Jr. ..... B32B 5/18
9,814,926 B1 * 11/2017 Izzolo, Jr. ..... A63B 21/4039
10,561,888 B2 * 2/2020 Chen ..... A63B 21/0023
2002/0072451 A1 * 6/2002 Scatterday ..... A63B 21/00189 482/49
2002/0117589 A1 * 8/2002 Ruan ..... A47B 21/0371 248/118.5
2002/0162919 A1 * 11/2002 Kuo ..... A47B 21/0371 248/118
2003/0125174 A1 * 7/2003 Lin ..... A63B 26/003 482/148
2003/0148865 A1 * 8/2003 Handshoe ..... A63B 22/18 482/148
2003/0209641 A1 * 11/2003 Cooke ..... G05G 1/62 248/118
2004/0087421 A1 * 5/2004 Lin ..... A63B 21/0004 482/146
2005/0148431 A1 * 7/2005 Laserow ..... A63B 21/0004 482/1
2006/0089241 A1 * 4/2006 Klein ..... A63B 21/00047 482/141
2006/0223677 A1 * 10/2006 Trent ..... A63B 21/028 482/44
2007/0265141 A1 * 11/2007 Marinello ..... A63B 69/0002 482/49
2008/0058166 A1 * 3/2008 Chuang ..... A63B 21/22 482/44
2008/0290226 A1 * 11/2008 Ho ..... G06F 3/0395 248/118
2010/0062918 A1 * 3/2010 Scholder ..... A63B 21/00047 482/148
2010/0071705 A1 * 3/2010 Alviso ..... A61F 5/0118 128/845
2010/0279833 A1 * 11/2010 Gant ..... A63B 23/1281 482/141
2011/0057088 A1 * 3/2011 Hsu ..... A47B 23/02 248/451
2011/0072581 A1 * 3/2011 Villa ..... A63B 21/4037 5/420
2012/0168575 A1 * 7/2012 Atzmon ..... A47B 21/0371 248/118
2012/0258841 A1 * 10/2012 James ..... A63B 21/00047 482/91
2012/0277078 A1 * 11/2012 Seade ..... A63B 21/4049 482/142
2012/0324645 A1 * 12/2012 Lehr ..... A47G 27/0237 5/420
2013/0213408 A1 * 8/2013 Andrews ..... A63B 71/14 128/846
2013/0316886 A1 * 11/2013 Lynch ..... A63B 21/4035 482/146
2013/0324382 A1 * 12/2013 Wilson ..... A63B 23/0211 482/142
2014/0135189 A1 * 5/2014 Thomason ..... A63B 23/1236 482/141
2014/0162858 A1 * 6/2014 Dalebout ..... A63B 26/003 482/142
2015/0072842 A1 * 3/2015 Segal ..... A63B 23/03533 482/141
2016/0361603 A1 * 12/2016 Blinova ..... A61H 1/005
2017/0144054 A1 * 5/2017 Landau ..... A41D 13/082
2017/0189742 A1 * 7/2017 Mangum ..... A63B 21/4037
2017/0296863 A1 * 10/2017 Pelosi ..... A63B 21/4039

* cited by examiner

ERGONOMIC HAND AND WRIST SUPPORT DEVICE FOR YOGA

CROSS-REFERENCE TO RELATED APPLICATIONS

This application claims priority to provisional application 62/446,842, filed Jan. 17, 2017, the entire contents of which are hereby incorporated by reference.

DESCRIPTION

Field of the Invention

The present invention generally relates to a hand/wrist support for yoga. More specifically, the present invention relates to hand/wrist supports that are placed under the user's hands.

BACKGROUND OF THE INVENTION

People incur a lot of shoulder and wrist injuries in life and yoga because the shoulder joint (the glenohumeral joint) is the most movable joint in the body, as well as the most dislocated joint in the body. This flexibility makes it susceptible to injury. Whenever there is pain in a joint (i.e., the wrist), it is useful to align the larger joints around that area. For instance, most wrist pain stems from improper shoulder alignment. Most people have poor shoulder alignment because of their sedentary lives, i.e., they sit in front of a desk, they sit in a car, their shoulders are collapsed, their heads are too far forward, and their arms are internally rotated. These people come into yoga predisposed with poor shoulder alignment, and then go into weight-bearing positions that their bodies can't handle. If the yogi's injury is not related to yoga, proper alignment while practicing yoga can help lessen the problem and the pain.

Yoga incorporates many positions where the hands are supporting the weight of the body, such as downward-facing dog, plank, and many balancing positions on the hands. Most yogis practice with a "flat" hand, which can dump the weight of the body onto the wrist, causing or exasperating injury and pain.

The wrist is made up of the carpals bones (where the carpal tunnel exists), then beyond that are the five metacarpals, followed by the five phalanges. In the feet the same blueprint arises: the tarsals are followed by the five metatarsals, then the phalanges (the toes). The tarsals in the feet are larger than the carpals in the hands, because the feet are meant to bear the body's weight. The carpals in the hand are smaller because they are not meant to bear weight. However, the phalanges in the hands are longer than the ones in the feet, because we are meant to grab things with our hands. There is also an arch (technically three arches in the foot) as well as a lift in the center of the palm.

Hand specialists recommend "backing off" to those who have wrist problems, and when ready to bear more weight, to proceed slowly on hands and knees, making sure to keep the wrist area lifted. Those with wrist problems or pain can also place more weight on their fingerpads, including at times staying on the fingertips when doing hand weight-bearing positions (if possible), or use a closed fist, but these alternative positions are not workable for many yoga positions. The idea behind staying on the fingertips is that this action lifts the hand into a position where the wrist is not bearing weight. This position also brings the palm into the "arch" position as opposed to flattening out. This more natural position relieves pain and does not cause or exacerbate injury to the delicate wrists.

Braces worn on the wrist to provide support are not a great option for those with wrist injuries, weakness or pain. Even a short, flexible wrist brace restricts flexion of the wrist in non-weight bearing positions and can be uncomfortable, especially when flexing with weight on the wrist. Wearing a cast-like wrist brace/support, with either metal plates, Velcro straps, and/or laces, offers excellent support in one position, but also forces the hand to be only in the one position the brace allows. With this type of wrist band, the yogi cannot flex the wrist at all. Yogis with wrist problems can be more comfortable, strengthen the wrist, and have a better practice without the brace. They can also focus on proper alignment, which is impossible in a cast-like wrist support that immobilizes the palms and/or fingers in addition to the wrist. Similarly, wrist supports with cushions or tubes that strap to the hands provide too much lift, do not allow for proper alignment and are cumbersome when doing standing poses because the supports are still attached to the hand with a Velcro or other type of strap. Finally, foam wedge supports have too much of an incline and cause "dumping" of weight into the hands and wrists regardless of the direction in which they are placed.

The present invention provides hand and wrist support for users while practicing yoga. The supports also help to place the hands in proper alignment during hand weight-bearing positions. There is a left and a right support, and they rest on the surface of the yoga mat. When the user is in a position that requires the hands to be on the mat, such as downward facing dog, the hands are placed over the supports.

DETAILED DESCRIPTION OF THE PREFERRED EMBODIMENTS

The present invention is like an orthotic for the hands. An orthotic for the foot provides arch support which places the foot in proper alignment, affecting the entire leg and hip. The same principle applies here. The hands should not be flat when on the mat. Ideally, when the hands press down evenly, the heels of the hands become lighter as the yogi muscularly draws the arms up, resulting in a balance between effort and surrender. As a result, the centers of the palms hollow and lift, like the arch of a foot. The present invention provides this lift and support so that the yogi is not "dumping" all of his/her weight into the hands/wrists, thereby helping maintain proper alignment up through the shoulders.

With the hand/wrist supports under the palms, the yogi will have the hands in the proper position and be able to find a "grounding down," as well as the support of the lift and resulting relief of pain and stress in the wrists.

The hand/wrist support consists of a firm yet pliable solid or mostly solid dome and is made of gel, urethane, silicone, foam or cork, and provides orthotic-like support to the hand. The underside of the hand support does not slip on a typical yoga mat. The user uses two supports and places one hand on the surface of each dome.

In one embodiment, the device may have a Shore A hardness of 35 to 55. In another embodiment, the device may have a Shore A hardness of 45 to 65. In another embodiment, the device has a Shore A hardness of 50 to 70. In another embodiment, the device has a Shore A hardness of 55 to 75.

In one embodiment, the dome is the upper portion of a sphere. The supports come in various sizes (e.g., extra small, small, medium, large, extra large) to accommodate the various sizes of hands. The support for an average woman's hand has a base with a 7-inch diameter and an apex of 1.5 inches; this particular size support is "sliced" off the top of a sphere with a diameter of 9.7 inches. In one embodiment, the ratio is 7:1. However, other variations are possible from 5:1 to 9:1.

In another embodiment, the dome is the upper portion of an oblate spheroid.

In another embodiment, the dome is the upper portion of an ellipsoid, such as a prolate spheroid.

The top surface of the support has texture/alignment bumps that (1) help provide traction; (2) stimulate the proprioceptors (nerve endings that tell us where we are in time and space) of the hand; as well as massage (like acupressure) tight areas of the hand; (3) help a sweaty hand breathe; and (4) serve as alignment markers. These bumps are in the shape of half-spheres with a diameter in the range of ⅛ to ⅓ inch. These bumps can also be in the shape of half-ellipsoids and rounded ridges.

In another embodiment, the hand support has no texture/alignment bumps. Alternatively, indicia may be printed or displayed on the hand support such that it is still smooth to the touch but one can visually see the indicia for alignment purposes.

In another embodiment, the hand support has no texture/alignment bumps, but rather texture/alignment indentations in the shapes of hollow half-spheres, half-ellipsoids or furrows.

In another embodiment, the hand support also has indentations for the thumbs to give a more grip-like feel and prevent slipping. The support might also have indentations for the forefinger and other fingers, as well.

The yogi uses a support that is large enough so that the hands and fingertips do not come in contact with the pad/floor. This enables the user to adjust hand position with ease either longitudinally or latitudinally to find that zone of comfort and the proper biomechanical alignment for him/her. There is no right way for everyone; yoga instructions are not "one-size fits all."

For more lift and to shift weight away from the wrist, the user can position the hand more forward and toward the medial part of the hand. For example, beginners, when in the downward dog position, tend to put more weight on the little-finger side of the hand (which connects to the ulna bone). This creates a problem because the yogi is using only half of the hand to support his/her body. Over time, a bad habit results. There is not adequate support on the thumb-side of the hand (which connects to the radius), so half of the arm does not get adequate support. Too much weight is placed on the ulna. This imbalance is the equivalent of someone standing on the outer edges of his/her feet and not the whole foot.

One of the most often given instructions in yoga is to "root down" on the index finger knuckles of the hands. By rooting down one part, other parts lift, in this case the palm, otherwise there is "dumping" into the wrists and the pinky-side of the hands. The supports automatically provide lift and enable the user to comfortably shift the hands slightly inward. Further, the bumps on the surface of the support awaken the medial part of the hands that are generally underused by yogis.

The texture/alignment bumps are positioned in bands. Each row can be of one color so that the "band" of bumps also serve as alignment markers to help the yogi achieve proper alignment. The proper placement of the hands in a hand weight-bearing yoga position is to: (1) have the crease of the wrists run in a straight line across the front plane (parallel to front edge of mat); (2) align the middle of the wrist in line with the outer deltoids; (3) place the middle of the wrist in the line with the space between middle and index fingers; and (4) fingers not too spread out, not too close together.

The latitudinal bump bands on the top surface of the support help the yogi align the wrist creases (as described in Item 1 above; See FIG. 1).

In another embodiment, the bumps are not colored and the dome has thin channels between the bumps that serve as visual alignment markers.

For yogis with wrist and shoulder pain and/or injuries, turning the hands slightly outward often brings relief. The hand support enables this outward turning, as well.

When the yogi is not using the hand supports during practice, they merely remain on the mat, enabling the hands to be free during standing and other positions that do not require use. The supports do not get in the way of vinyasa because most foot positions will be either in the center of the mat or away from the supports. If the supports need to be moved, they are as easily movable as yoga blocks.

Although several embodiments have been described in detail for purposes of illustration, various modifications may be made to each without departing from the scope and spirit of the invention. Accordingly, the invention is not to be limited, except as by the appended claims.

BRIEF DESCRIPTION OF THE DRAWINGS

The accompanying drawings illustrate the invention. In such drawings.

DETAILED DESCRIPTION OF THE PREFERRED EMBODIMENTS

FIGS. 1-6 show an embodiment of an ergonomic hand and wrist support device 10 of the present invention. The device has a flat bottom surface 12 having a circular perimeter 14. A curved top surface 16 is then opposite the bottom surface 12, where the curved top surface 16 is connected to the bottom surface 12 at the commonly shared circular perimeter 14.

Figure 1:
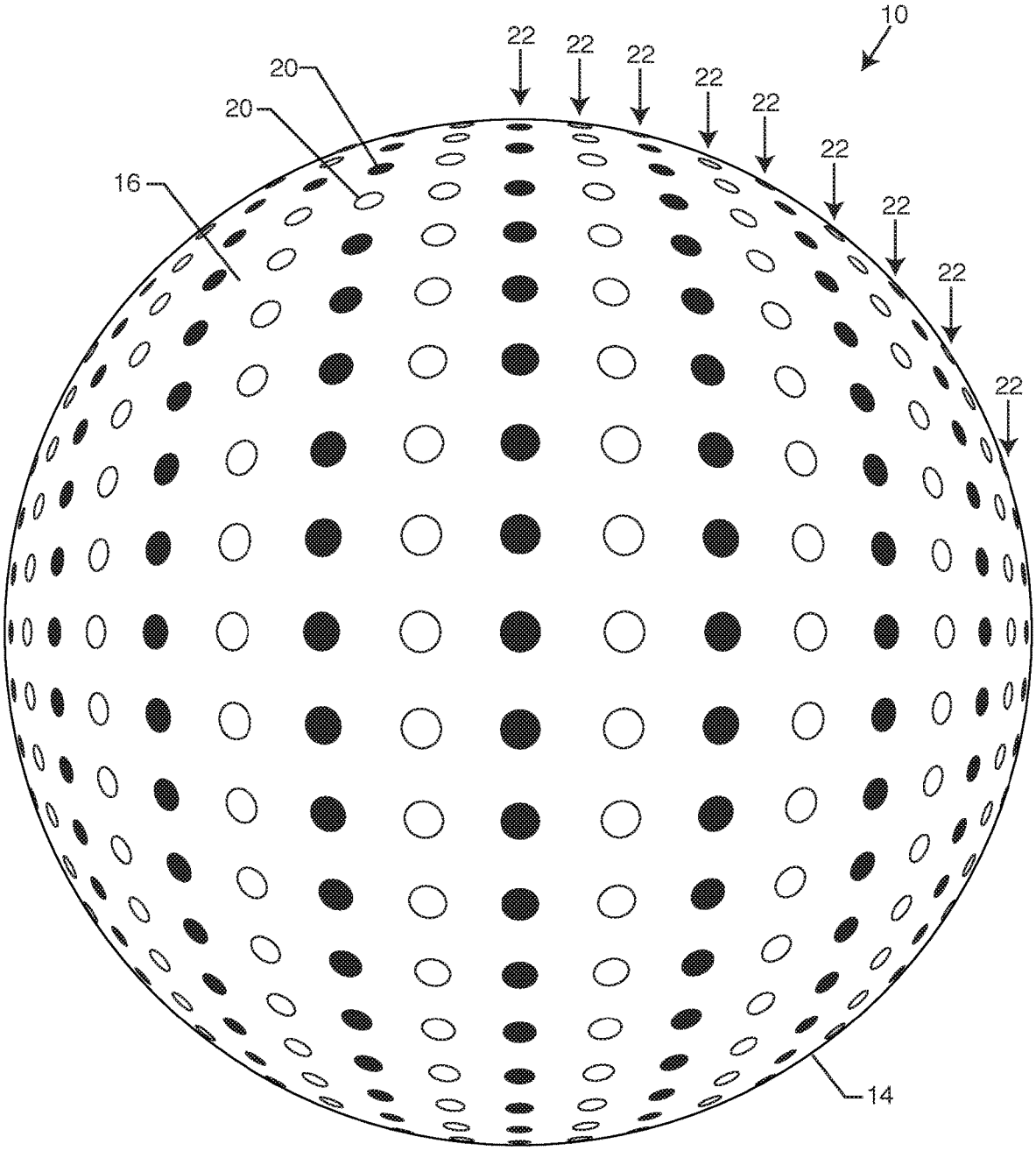
FIG. 1 is a top view of the hand/wrist support device showing the dome support and texture bumps/alignment markers.
Figure 2:
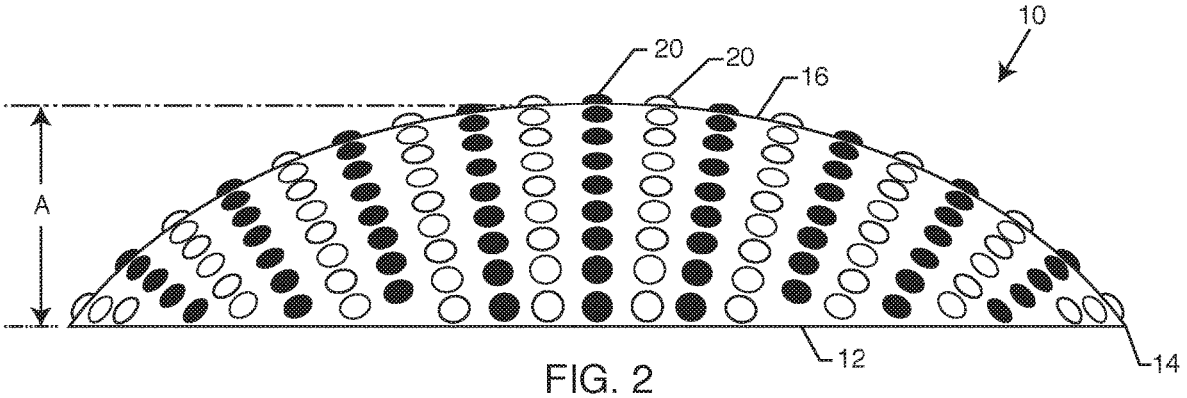
FIG. 2 is a front plan view of the embodiment of FIG. 1.
Figure 3:
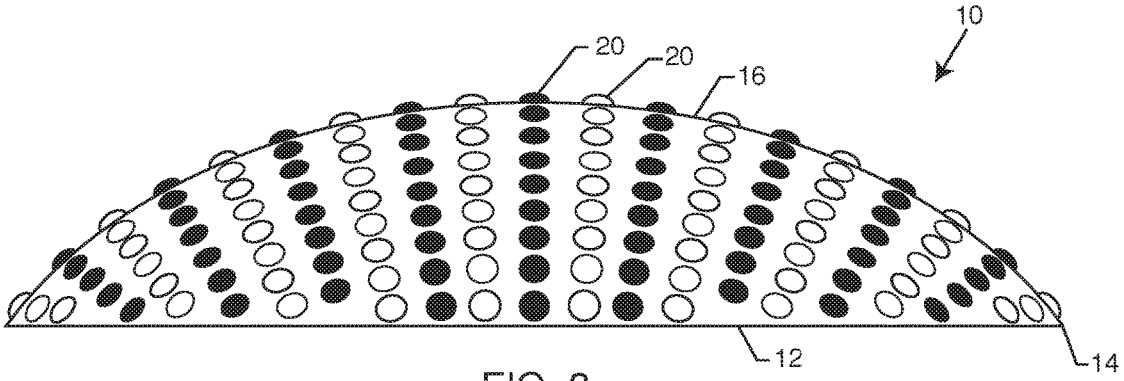
FIG. 3 is a rear plan view of the embodiment of FIG. 1.
Figure 4:
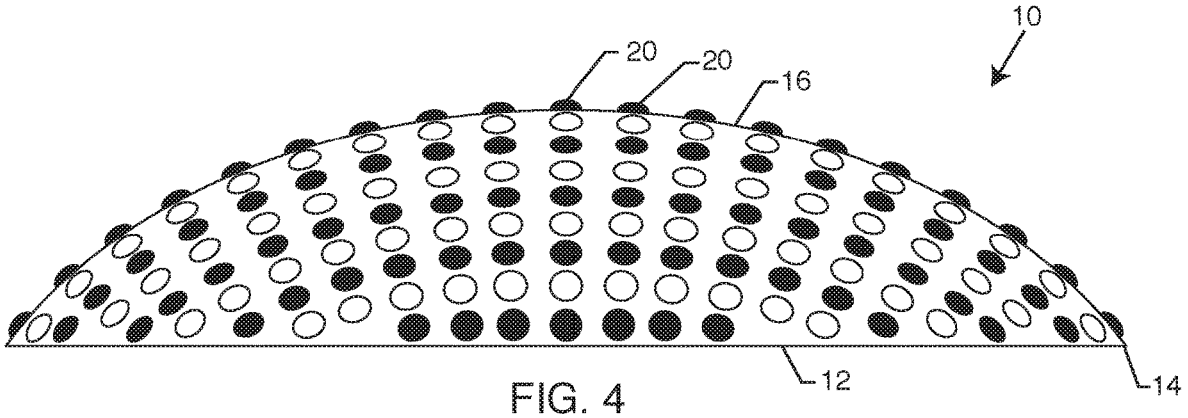
FIG. 4 is a right-side plan view of the embodiment of FIG. 1.
Figure 5:
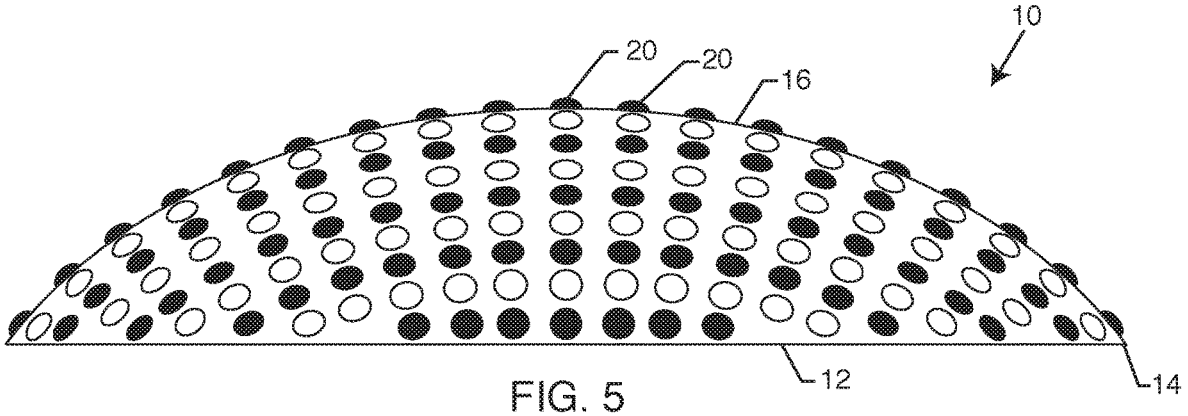
FIG. 5 is a left side plan view of the embodiment of FIG. 1.
Figure 6:
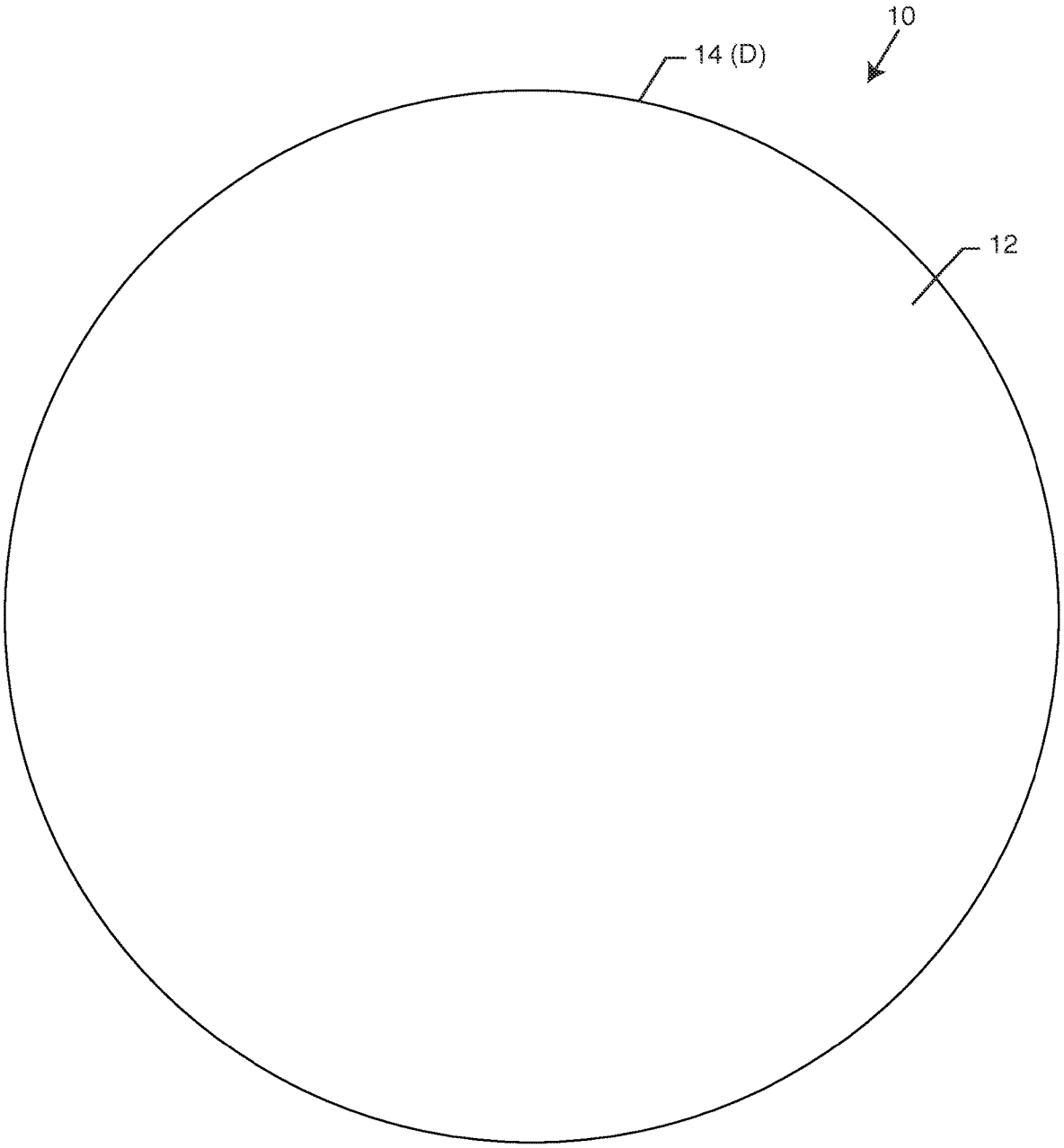
FIG. 6 is a bottom view of the embodiment of FIG. 1.
Figure 7:
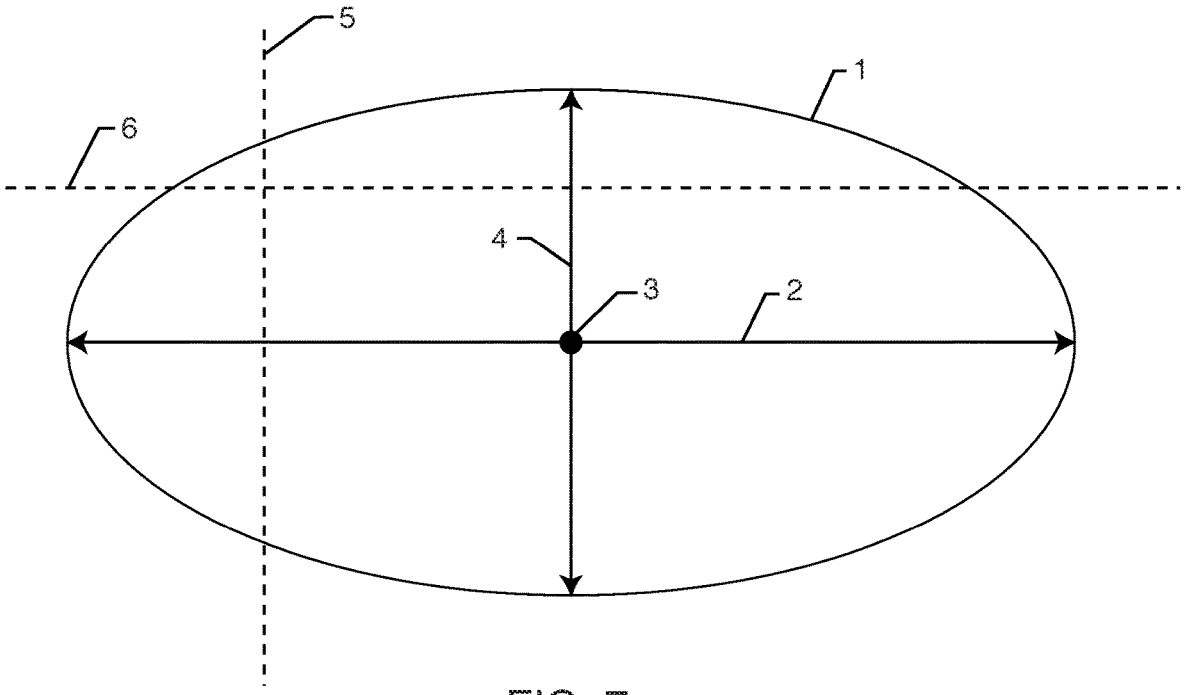
FIG. 7 shows the geometry of an ellipse.

Referring now to FIG. 7, FIG. 7 shows an ellipse 1. The ellipse 1 has a major axis 2 that runs through the center 3 and is its longest diameter. The ellipse 1 also has a minor axis 4 that runs through the center 3 and is its shortest diameter. Both the major and minor axes are perpendicular to one another. If the major and minor axes were of the same length, then the ellipse 1 would be a circle with a constant diameter/radius.

A semi-major axis is just half of the major axis 2 that runs from the center to one of the ends. Similarly, a semi-minor axis is just half of the minor axis 4 that runs from the center to one of the ends.

If one was to rotate the ellipse 1 about the major axis 2, the volume that is created is referred to as a prolate spheroid. In other words, it would look like a sphere was stretched. If one was to rotate the ellipse 1 about the minor axis 4, the volume that is created is referred to as an oblate spheroid. In other words, it would look like a sphere was squashed.

The shape of the device 10 can be made/formed by slicing a sphere, a prolate spheroid or an oblate spheroid. The slice is flat and straight and forms the flat bottom surface 12. The resulting curved top surface 16 is that of either the sphere, the prolate spheroid or the oblate spheroid. Referring again to FIG. 7, is one was to make a slice 5 through the prolate spheroid, the resulting left portion would form the shape of the present device 10. Similarly, if one was to make a slice 6 through the oblate spheroid, the resulting upper portion would then form the shape of the present device 10.

In the inventors' experience, the optimal shape for the device 10 is the oblate spheroid shape. When a hand is at rest, it is naturally and slightly cupped. Rotate a hand at rest and it forms an oblate spheroid. A neutral hand when placed on a surface has connection with that surface, but it also has space (like a foot). This inner lift should be maintained. When using the device, the yogi can rotate the hands either longitudinally or latitudinally on the device to achieve the most comfortable and desirable position. The oblate spheroid is the optimal shape to provide the most anatomically correct support possible under the hands.

The device 10 can be made of a single material, such as silicone or urethane, or can be constructed as a composite, meaning it can be several different materials over molded upon one another. The device 10 has to hold its shape but also compress enough so it is comfortable to use and can form to the user's hands for optimal support. Therefore, the Shore A hardness may vary between 35 to 55, 45 to 65, 50 to 70, 55 to 75 or any combination thereof or in between.

The device may include a plurality of texture and/or alignment bumps 20 disposed on the curved top surface 16. As shown herein, there are a number of 250 texture (alignment) bumps. It will be understood that more or less texture (alignment) bumps may be used. For example, at least 50, 100, 150, 200 or 250 texture (alignment) bumps may be used.

The plurality of texture/alignment bumps 20 are organized into a plurality of rows 22. As shown herein, there are a number of 17 rows. It will be understood that more or less rows may be used. For example, at least 3, 4, 5, 6, 7, 8, 9, 10, 11, 12, 13, 14, 15, 16 or more rows may be used.

As shown herein, the circular perimeter 14 has a diameter "D" of 7 inches. Then, apex height "A" is defined as a distance extending perpendicular from the flat bottom surface to the furthest point of the curved top surface and wherein the apex height is located at a center of the circular perimeter, which would also correspond to the center 3 of the ellipse 1. In this embodiment the apex height A is 1.5 inches or less. These measurements can also be expressed a ratio of D to A, in other words D:A. Using the same values, the ratio can be expressed as 7:1.5 or greater, where the D can increase or the A can decrease. In other words, 7 divided by 1.5 is equal to approximately 4.667, so any value above this would be a greater ratio. In another embodiment, a ratio of 4:1 or greater may be used.

Although several embodiments have been described in detail for purposes of illustration, various modifications may be made to each without departing from the scope and spirit of the invention. Accordingly, the invention is not to be limited, except as by the appended claims.

What is claimed is:

1. An ergonomic hand and wrist support device for yoga, the device comprising:

a flat bottom surface having a circular perimeter; and a curved top surface opposite the bottom surface, the top surface connected to the bottom surface at the circular perimeter;

wherein the curved top surface has the shape of an oblate spheroid, the oblate spheroid defining a major axis perpendicular to a minor axis;

wherein the flat bottom surface is perpendicular to a minor axis of the oblate spheroid;

wherein the oblate spheroid is defined as having 360 degrees of rotational symmetry around the minor axis; and wherein the circular perimeter is of a constant radius about the minor axis of the oblate spheroid;

wherein the device is not an inflatable device.

2. The device of claim 1, including a plurality of texture bumps disposed on the curved top surface.

3. The device of claim 2, wherein the plurality of texture bumps are organized into a plurality of rows.

4. The device of claim 3, wherein there are at least 10 rows from the plurality of rows.

5. The device of claim 4, wherein there are at least 150 texture bumps from the plurality of texture bumps.

6. The device of claim 1, wherein the circular perimeter has a diameter of 7 inches.

7. The device of claim 6, wherein an apex height is defined as a distance extending perpendicular from the flat bottom surface to the furthest point of the curved top surface and wherein the apex height is located at a center of the circular perimeter, wherein the apex is 1.5 inches or less.

8. The device of claim 1, wherein the circular perimeter has a diameter D, and wherein an apex height A is defined as a distance extending perpendicular from the flat bottom surface to the furthest point of the curved top surface where the apex height A is located at a center of the circular perimeter, wherein the ratio of diameter D to apex height A is D:A, which is 7:1.5 or greater.

9. The device of claim 1, wherein the circular perimeter has a diameter D, and wherein an apex height A is defined as a distance extending perpendicular from the flat bottom surface to the furthest point of the curved top surface where the apex height A is located at a center of the circular perimeter, wherein the ratio of diameter D to apex height A is D:A, which is 4:1 or greater.

10. The device of claim 1, wherein the device comprises a Shore A hardness of 35 to 55.

11. The device of claim 1, wherein the device comprises a Shore A hardness of 45 to 65.

12. The device of claim 1, wherein the device comprises a Shore A hardness of 50 to 70.

13. The device of claim 1, wherein the device comprises a Shore A hardness of 55 to 75.

14. The device of claim 1, wherein the device is solid throughout.

15. The device of claim 1, wherein the device is made of a single material that is solid throughout free of any inflatable cavities.

16. An ergonomic hand and wrist support device for yoga, the device comprising:

a flat bottom surface having a circular perimeter; and a curved top surface opposite the bottom surface, the top surface connected to the bottom surface at the circular perimeter;

wherein the curved top surface has the shape of an oblate spheroid, the oblate spheroid defining a major axis perpendicular to a minor axis;

wherein the flat bottom surface is perpendicular to a minor axis of the oblate spheroid;

wherein the oblate spheroid is defined as having 360 degrees of rotational symmetry around the minor axis; and wherein the circular perimeter is of a constant radius about the minor axis of the oblate spheroid;

wherein the device is solid throughout.

17. An ergonomic hand and wrist support device for yoga, the device comprising:

a flat bottom surface having a circular perimeter; and a curved top surface opposite the bottom surface, the top surface connected to the bottom surface at the circular perimeter;

wherein the curved top surface has the shape of an oblate spheroid, the oblate spheroid defining a major axis perpendicular to a minor axis;

wherein the flat bottom surface is perpendicular to a minor axis of the oblate spheroid;

wherein the oblate spheroid is defined as having 360 degrees of rotational symmetry around the minor axis; and wherein the circular perimeter is of a constant radius about the minor axis of the oblate spheroid;

wherein the device is made of a single material that is solid throughout free of any inflatable cavities.

* * * * *